US010962187B2

(12) United States Patent
Feil et al.

(10) Patent No.: US 10,962,187 B2
(45) Date of Patent: Mar. 30, 2021

(54) PRIMARY OPTICAL UNIT, SECONDARY OPTICAL UNIT, MODULE, ARRANGEMENT, VEHICLE HEADLIGHT, AND HEADLIGHT SYSTEM

(71) Applicant: OSRAM GmbH, Munich (DE)

(72) Inventors: Thomas Feil, Iggingen (DE); Andreas Hartmann, Ulm (DE); Eugen Pappelheim, Heidenheim (DE)

(73) Assignee: OSRAM Beteiligungsverwaltung GmbH, Grünwald (DE)

( * ) Notice: Subject to any disclaimer, the term of this patent is extended or adjusted under 35 U.S.C. 154(b) by 191 days.

(21) Appl. No.: 15/825,189

(22) Filed: Nov. 29, 2017

(65) Prior Publication Data

US 2018/0156406 A1 Jun. 7, 2018

(30) Foreign Application Priority Data

Dec. 1, 2016 (DE) ..... 10 2016 223 972.4

(51) Int. Cl.

| | |
|---|---|
| ***F21S 41/00*** | (2018.01) |
| ***F21S 41/24*** | (2018.01) |
| ***F21S 41/143*** | (2018.01) |
| ***F21S 41/151*** | (2018.01) |
| ***F21S 41/32*** | (2018.01) |
| ***F21S 41/26*** | (2018.01) |
| ***F21S 41/663*** | (2018.01) |

(Continued)

(52) U.S. Cl.

CPC ..... *F21S 41/00* (2018.01); *F21S 41/143* (2018.01); *F21S 41/151* (2018.01); *F21S 41/24* (2018.01); *F21S 41/26* (2018.01); *F21S 41/322* (2018.01); *F21S 41/663* (2018.01); *F21V 13/02* (2013.01); *F21W 2102/145* (2018.01)

(58) Field of Classification Search

USPC ..... 362/538

See application file for complete search history.

(56) References Cited

U.S. PATENT DOCUMENTS 5,931,576 A * 8/1999 Kreysar ..... F21S 41/24 362/552
2012/0236583 A1* 9/2012 Ochiai ..... B60Q 1/0047 362/519

(Continued)

FOREIGN PATENT DOCUMENTS

AT 512246 B1 2/2014
AT 513341 B1 6/2015

(Continued)

OTHER PUBLICATIONS

German Search Report based on application No. 10 2016 223 972.4 (8 pages) dated May 30, 2017 (Reference Purpose Only).

(Continued)

*Primary Examiner* — Michael G Lee
*Assistant Examiner* — David Tardif

(57) ABSTRACT

In various embodiments, an optical unit for a radiation source matrix is provided. The optical unit may include a plurality of coupling surfaces, which are arranged in at least one line, and at least one decoupling surface. At least one coupling surface, which is arranged at a line end of the line formed by the coupling surfaces arranged in at least one line, is widened when viewed in the direction of the at least one line.

11 Claims, 6 Drawing Sheets

(51) Int. Cl.
*F21V 13/02* (2006.01)
*F21W 102/145* (2018.01)

(56) References Cited

U.S. PATENT DOCUMENTS

| | | | | |
|---|---|---|---|---|
| 2014/0009938 | A1* | 1/2014 | Hossfeld | F21S 41/26 362/244 |
| 2014/0321141 | A1 | 10/2014 | Bauer et al. | |
| 2015/0131305 | A1 | 5/2015 | Courcier et al. | |
| 2015/0226395 | A1 | 8/2015 | Taudt et al. | |
| 2015/0276157 | A1* | 10/2015 | Oguchi | F21S 41/143 362/514 |
| 2017/0130924 | A1 | 5/2017 | Kawai et al. | |
| 2017/0307166 | A1 | 10/2017 | Courcier et al. | |

FOREIGN PATENT DOCUMENTS

| | | | |
|---|---|---|---|
| CN | 1948821 | A | 4/2007 |
| EP | 2743567 | A1 | 6/2014 |
| WO | 2009130655 | A2 | 10/2009 |
| WO | 2013075157 | A1 | 5/2013 |
| WO | 2014032071 | A1 | 3/2014 |
| WO | 2016013447 | A1 | 1/2016 |
| WO | 2016050983 | A1 | 4/2016 |

OTHER PUBLICATIONS

European Search Report based on application No. 17197505.5 (9 pages) dated Feb. 26, 2018 (for reference purpose only).

* cited by examiner

PRIMARY OPTICAL UNIT, SECONDARY OPTICAL UNIT, MODULE, ARRANGEMENT, VEHICLE HEADLIGHT, AND HEADLIGHT SYSTEM

CROSS-REFERENCE TO RELATED APPLICATION

This application claims priority to German Patent Application Serial No. 10 2016 223 972.4, which was filed Dec. 1, 2016, and is incorporated herein by reference in its entirety.

TECHNICAL FIELD

Various embodiments relate generally to an optical unit, e.g. a primary optical unit. Furthermore, various embodiments relate to an optical unit, e.g. a secondary optical unit. Furthermore, various embodiments provide a module having a radiation source matrix. Moreover, various embodiments relate to an arrangement having a plurality of radiation source matrices and optical units. In addition, a vehicle headlight is provided.

BACKGROUND

So-called matrix headlights for vehicles are known. They have a matrix made of light-emitting diodes (LEDs). In this case, each individual LED can be separately activated and in this way turned on and off and also dimmed. The LEDs can be arranged in a single line or multiple lines and each form a light pixel.

SUMMARY

In various embodiments, an optical unit for a radiation source matrix is provided. The optical unit may include a plurality of coupling surfaces, which are arranged in at least one line, and at least one decoupling surface. At least one coupling surface, which is arranged at a line end of the line formed by the coupling surfaces arranged in at least one line, is widened when viewed in the direction of the at least one line.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

Figure 1A:
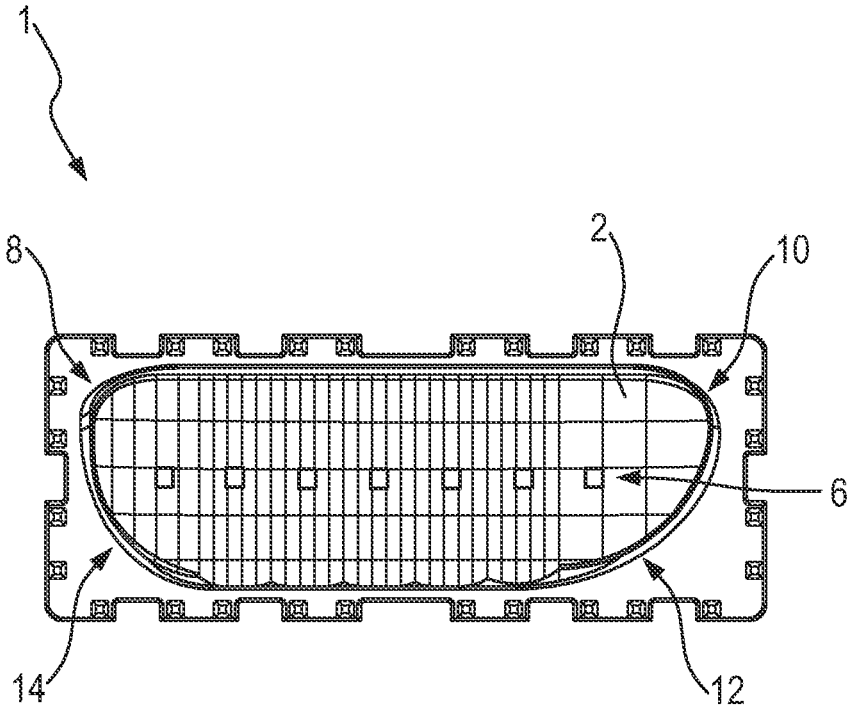
FIGS. 1A and 1B show different views of an optical unit (primary optical unit) according to various embodiments.

According to FIG. 1A, an optical unit is shown as a primary optical unit 1 in a front view, wherein a decoupling surface 2 is visible. In addition, because of the transparent embodiment of the primary optical unit 1, a structure of a rear coupling surface 4, see also FIG. 1B, and a radiation source matrix 6 are also visible. A side view of the primary optical unit 1 is shown according to FIG. 1B.

It can be seen in FIG. 1A that the decoupling surface 2 has four corner regions 8 to 14. They are embodied as rounded. The upper corner regions 8 and 10 according to FIG. 1*a* have a smaller radius in this case than the lower corner regions 12 and 14. In the installed state of the primary optical unit 1 in a vehicle headlight, the corner regions 8 and 10 are also arranged on top when viewed in the vertical direction. Due to the asymmetrical trimming of the decoupling surface 2, an asymmetrical light image can be generated. The primary optical unit 1 is the primary optical unit for the left vehicle headlight of a vehicle. The corner regions 8 and 14 are on the inside in an installed state in this case and the other corner regions 10 and 12 are on the outside. A trimming or rounding of the corner region 12 is larger in this case than that of the corner region 14.

As already explained above, the coupling surface 4 is visible in FIG. 1B. The one-line radiation source matrix 6 is shown opposite thereto, which has seven radiation sources in the form of light-emitting diodes (LEDs) 16 to 28. In various embodiments, the OSRAM type OSLON Black Flat (LUW HWQP) can be used as the LED light source, having a brightness bin of 6N (or higher) and having an electrical power consumption of 4.55 W. According to FIG. 1B, the coupling surface 4 for a respective LED 16 to 28 has a segmented coupling surface 30 to 42. In this case, the coupling surfaces 30 and 42 are arranged on the edge and the coupling surfaces 32 to 40 are arranged in the middle. The embodiment of the middle coupling surfaces 32 to 40 is identical in this case. In contrast, a width of the edge-side coupling surfaces 30 and 42 is wider when viewed in the line direction of the LEDs 16 to 28 than that of the middle coupling surfaces 32 to 40. In other words, an asymmetrical design is achieved by the corresponding embodiment of the coupling surfaces 30 and 42 provided as lateral segments. In this way, an asymmetrical light distribution and an optimized ratio of light image width to center resolution are enabled. Depending on the number of the LEDs 16 to 28, the asymmetry can be made stronger, e.g. with fewer LEDs, or less, e.g. with many LEDs. The light distribution is then designed depending on the number of the LEDs 16 to 28 so that the central region, e.g. with an LED number of less than or equal to 8, provide a uniform pixel distribution, and the edge regions provide an asymmetrical light distribution. The fewer LEDs 16 to 28 are provided, the greater can the asymmetry of the edge-side coupling surfaces 30 and 42 be selected, to generate a correspondingly broad light distribution. Such a one-line radiation source matrix is sold by OSRAM under the product names SMATRIX or sMArTRIX.

Figure 2:
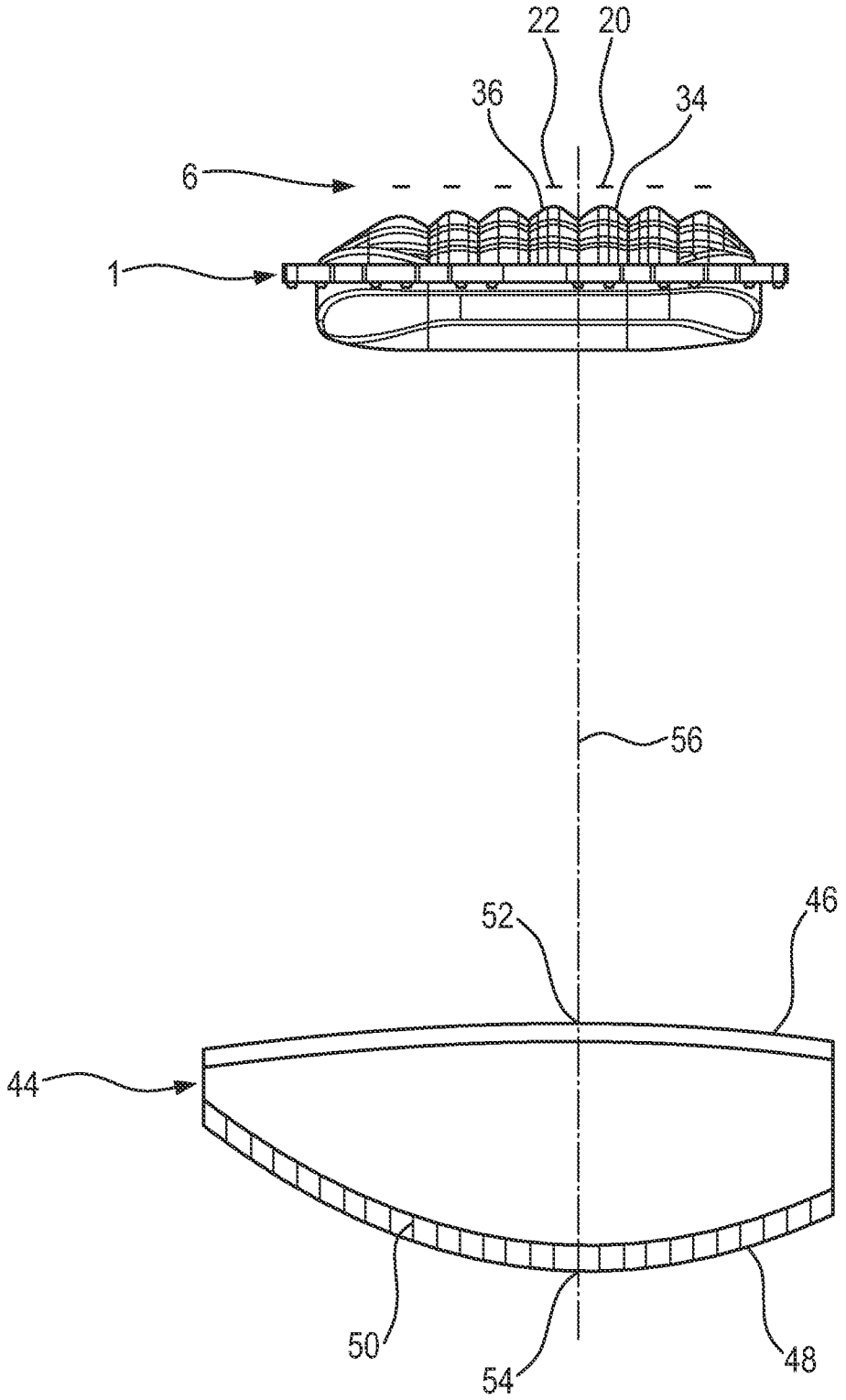
FIG. 2 shows a top view of a group which has a radiation source matrix, the optical unit (primary optical unit) from FIG. 1*a* and FIG. 1*b* and a further optical unit (secondary optical unit)

According to FIG. 2, the radiation source matrix 6 having the downstream primary optical unit 1 is shown. Furthermore, an optical unit in the form of a secondary optical unit 44 is provided, which is connected downstream of the primary optical unit 1. The secondary optical unit 44 is also embodied asymmetrically. It has an asymmetrical coupling surface 46 and an asymmetrical decoupling surface 48. The decoupling surface 48 has a structure in the form of lines 50 extending in the vertical direction, of which only one is provided with a reference sign for the sake of simplicity. Both the coupling surface 46 and also the decoupling surface 48 are embodied convexly, wherein the optical main axis 56 extends through a respective vertex 52, 54. It is offset in this case in relation to the middle of the secondary optical unit 44. Furthermore, the optical main axis 56 extends between the coupling surfaces 34 and 36 and therefore between the LEDs 20 and 22. It is conceivable to slightly incline the main axis 56 in relation to the line-shaped radiation source matrix 6.

Figure 3:
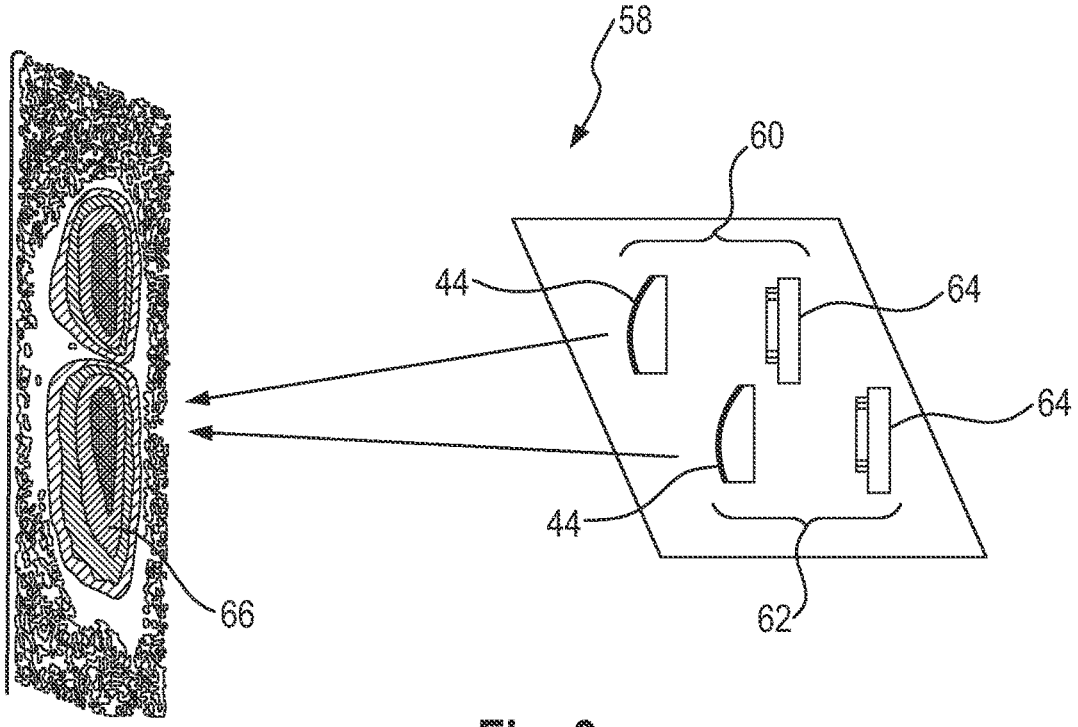
FIG. 3 schematically shows an arrangement of two groups from FIG. 2 together with a common emitted light image.
Figure 4:
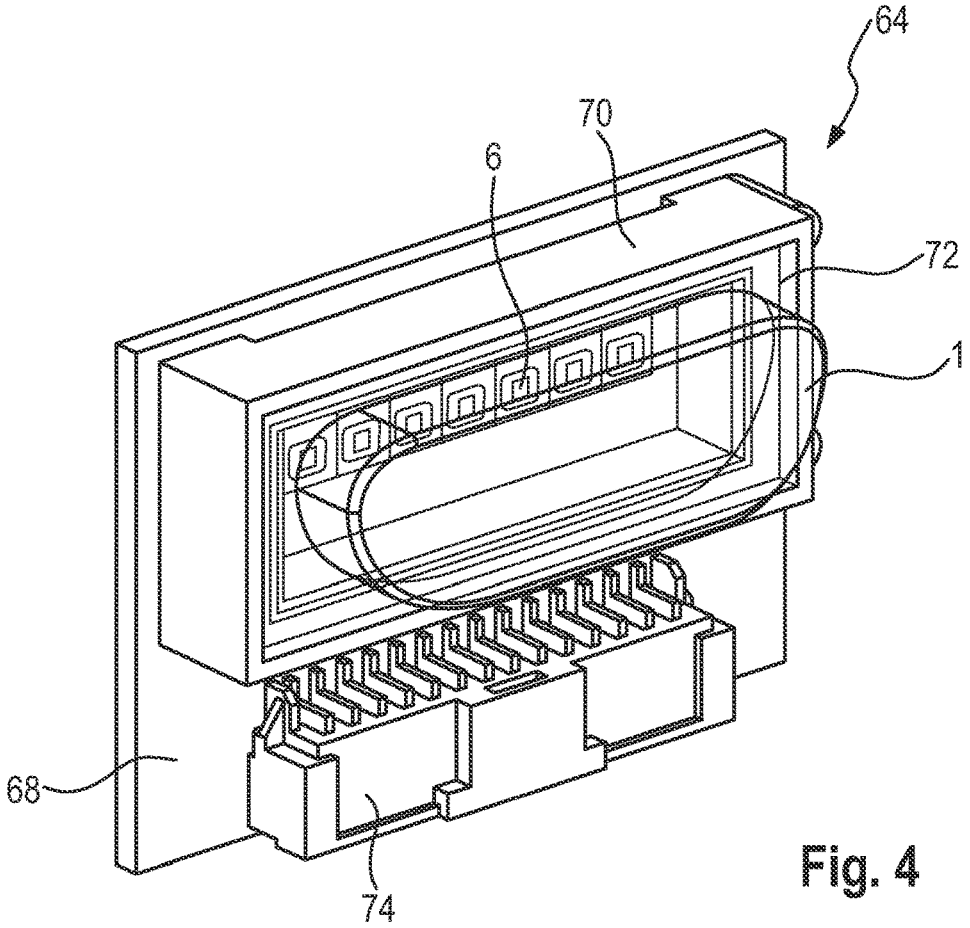
FIG. 4 shows a perspective illustration of a module according to various embodiments.

FIG. 3 shows an arrangement 58 having a first group 60 and a second group 62. A respective group 60, 62 has a module 64 in this case, which is shown in FIG. 4. Furthermore, a respective group has the secondary optical unit 44 connected downstream of the module 64. The groups 60 and 62 are arranged in this case such that the light images thereof overlap and form a common light image 66, which may fulfill the ECE standard for vehicle headlights.

According to FIG. 4, the module 64 has a printed circuit board 68, on which the radiation source matrix 6 is fastened. Furthermore, an optical unit holder in the form of a frame 70, which encloses the radiation source matrix 6, is arranged on the printed circuit board 68. The primary optical unit 1 is mounted via its radial collar 72 via the frame 70, see also FIG. 1B. Furthermore, a terminal 74 is provided on the printed circuit board 68. A respective module 64 from FIG. 3 therefore has seven LEDs 16 to 28, see also FIG. 1B. The light image 66 can therefore be controlled using a total of 14 LEDs.

Figure 5A:
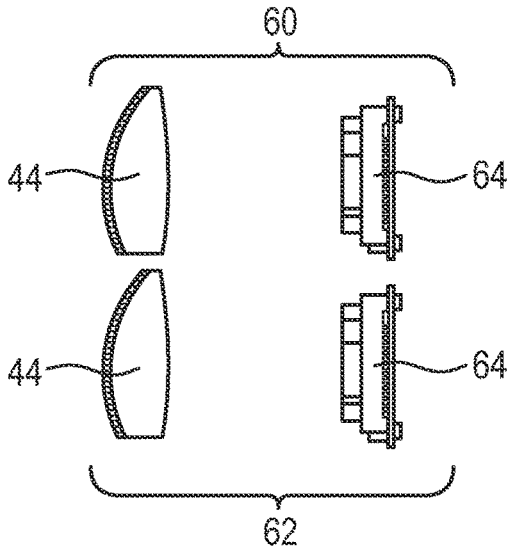
FIGS. 5A and 5B show various views of two groups according to various embodiments.
Figure 5B:
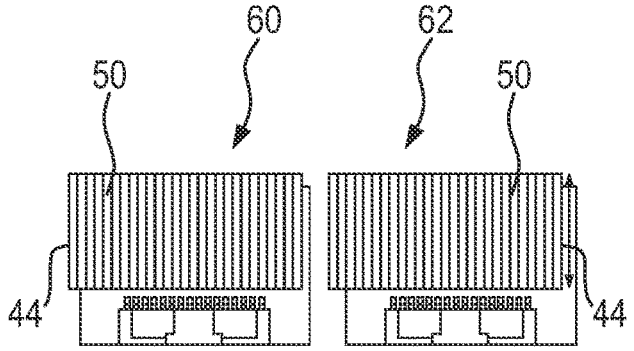

According to FIG. 5*a*, the groups 60 and 62 are shown, in which the secondary optical units 44 and the modules 64 are arranged adjacent to one another. In contrast, the groups 60 and 62 are arranged offset in relation to one another in FIG. 3. FIG. 5*b* shows a front view of the groups 60 and 62. The lines 50 of the secondary optical units 44 are recognizable in this case, which extend with parallel spacing to one another and in the vertical direction.

Figure 6:
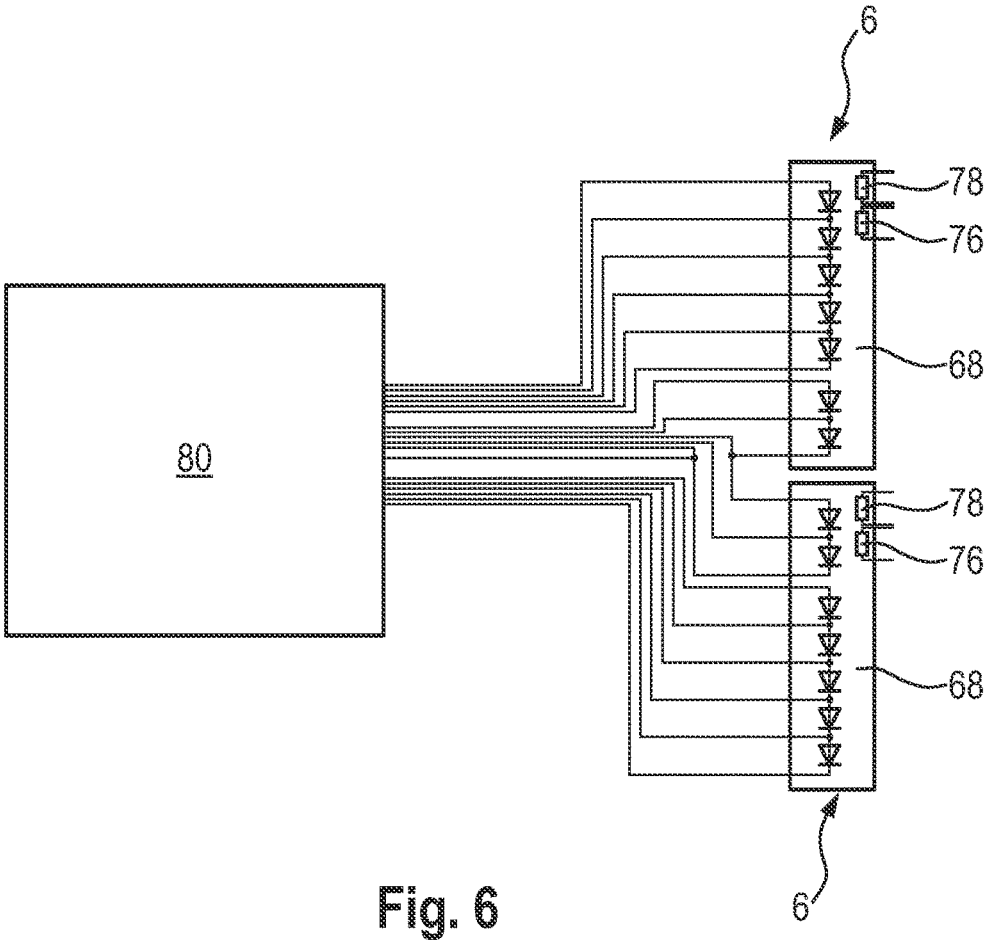
FIG. 6 schematically shows two radiation source matrices.

According to FIG. 6, the radiation source matrices 6 of the modules 64 of the groups 60 and 62 from FIG. 5*a* are shown. It is recognizable in this case that for a respective printed circuit board 68, a binning resistor 76 and an NTC resistor 78 are provided. A control module (LED Driver Module (LDM)) 80 is provided for controlling the individual LEDs.

Figure 1B:
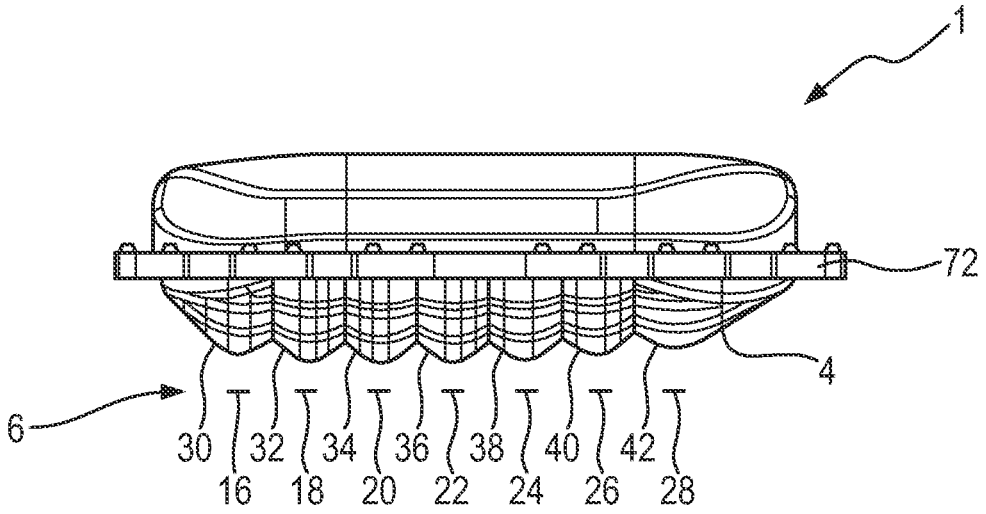
Figure 7:
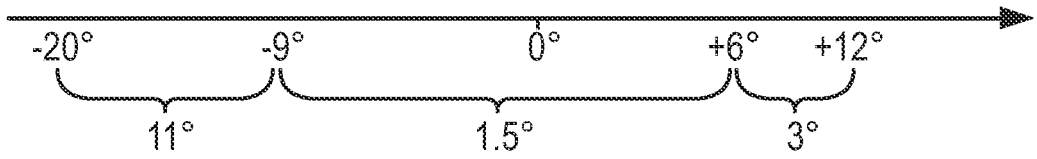
FIG. 7 shows different resolutions over an angle range of a light image emitted by the arrangement from FIG. 3.

According to FIG. 7, the illuminated angle range of the light image 66 from FIG. 3 is shown. According to FIG. 1*b*, the middle LEDs 18 to 26 with the middle coupling surfaces 32 to 40 each illuminate an angle range of 3° in the light image 66 from FIG. 3, measured in a plane which extends according to FIG. 2 in the optical main axis 56 and the line of the radiation source matrix 6. The light images of the modules 64 from FIG. 3 are then overlapped such that the angle ranges illuminated by the middle LEDs 18 to 24 from FIG. 1*b* overlap uniformly. In this way, according to FIG. 7, a resolution of 1.5° is provided in the middle angle range. The 0° position marks in this case the position of the optical main axis 56, see also FIG. 2. The middle angle range having the resolution of 1.5° is thus provided from −0° to +6° and therefore extends over a range of a total of 15°. This is adjoined, on the one hand, on the left by the angle range which, according to FIG. 1B, is illuminated by the LEDs 28 and the coupling surfaces 42 of a respective module 64, see FIG. 3B. On the other hand, the angle range adjoins on the right which, according to FIG. 1B, is illuminated by the LEDs 16 and the coupling surfaces 30 of the modules 64, see FIG. 3. The left angle range then extends from −20° to −9° and the right angle range extends from +6° to +12°. A resolution of the left angle range is 11° and a resolution of the right angle range is 3°.

Figure 8:
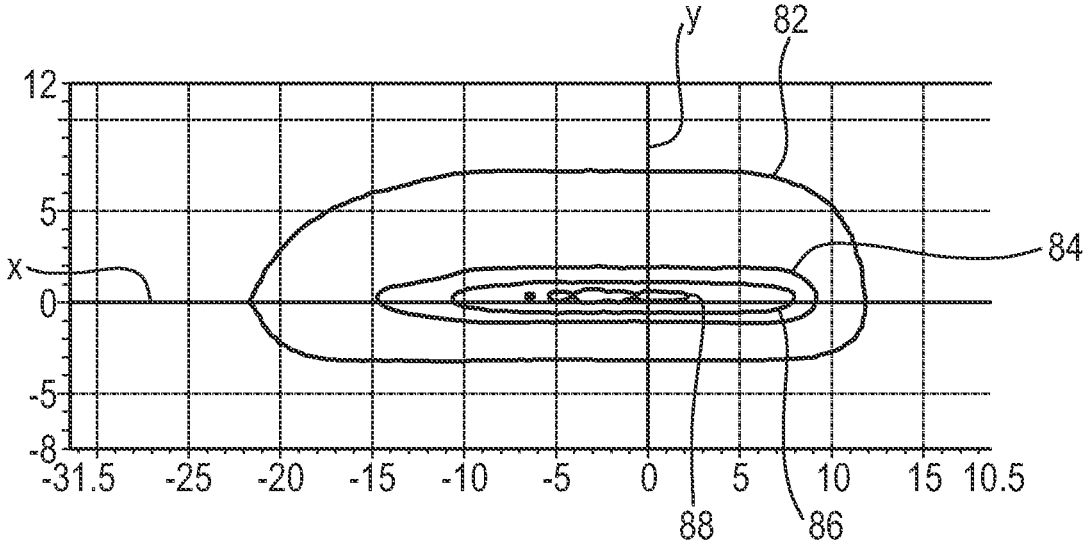
FIG. 8 shows a luminosity distribution of a light image which is emitted by the arrangement from FIG. 3.

According to FIG. 8, the lines of equal luminosity of the light image from FIG. 3 are shown, wherein all LEDs of the modules 64 are turned on. The optical main axis 56 from FIG. 2 is located in this case in the intersection of the axes x and y. The outer line 82 has in this case a luminosity of 625 cd, the next inner line 84 has a luminosity of 25000 cd, the next inner line 86 has a luminosity of 50000 cd, and the inner line 88 has a luminosity of 75000 cd.

Figure 9:
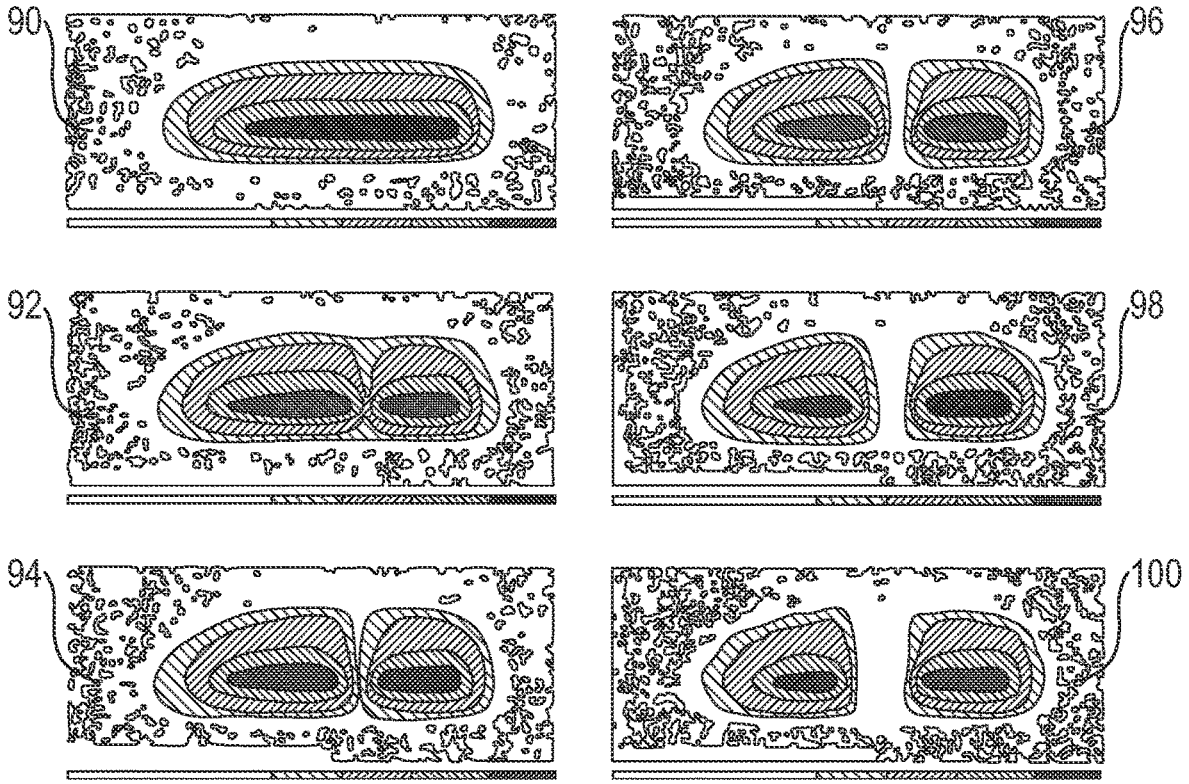
FIG. 9 shows various light images which are emitted by the arrangement according to FIG. 3, wherein a different number of radiation sources is switched on in each case.

FIG. 9 shows various light images 90 to 100 of the arrangement 58 from FIG. 3. The light images 90 to 100 are acquired in this case in a plane which extends transversely to the optical main axis 56 from FIG. 2. All LEDs are turned on in the light image 90. The LEDs 22, see FIG. 1*b*, of a respective module 64 from FIG. 3 are turned off in the light image 92, whereby an angle range of 3° is no longer illuminated. According to light image 94, two LEDs 22 and 24 in one of the modules 64 and one LED 22 in the other module 64 are turned off, whereby an angle range of 4.5° is not illuminated. The LEDs 22 and 24 are then turned off in a respective module 64 in the light image 96. In one of the modules 64, the LED 26 is additionally turned off in the light image 98. The LEDs 22 to 26 are turned off in both modules 64 in the light image 100, whereby an angle range of 9° is not illuminated.

A primary optical unit is disclosed having a decoupling surface and a plurality of coupling surfaces, which can be arranged opposite to a radiation source matrix. The coupling surfaces arranged in a line have a terminal coupling surface on one side and a further terminal coupling surface on the other side. At least one of the terminal coupling surfaces is formed widened in comparison to a respective middle coupling surface.

Various embodiments provide an optical unit, e.g. a primary optical unit, for a radiation source matrix, an optical unit, e.g. a secondary optical unit, for the radiation source matrix, a module having a radiation source matrix, an arrangement, a headlight, and a headlight system, to generate a high-quality light image in a cost-effective manner.

In various embodiments, an optical unit, e.g. a primary optical unit, is provided for a radiation source matrix. It has a plurality or multiplicity of coupling surfaces arranged in at least one line and at least one decoupling surface. At least one of the coupling surfaces, which is arranged at a line end of the line formed by the coupling surfaces arranged in at least one line, and which is also referred to hereafter as a lateral or edge-side coupling surface, is widened when viewed in the direction of the at least one line. At least one edge-side coupling surface can therefore be wider than a middle coupling surface.

Such an optical unit (primary optical unit) enables in use in the case of an upstream radiation source matrix, an asymmetrical light distribution and an optimized ratio of light image width to center resolution. This is extraordinarily advantageous upon the use of the optical unit (primary optical unit) in a vehicle headlight of a vehicle, since, in a cost-effective manner, a comparatively high resolution is achieved in the center region and a widened light image is provided in the edge region, by simply widening at least one of the edge-side coupling surfaces.

In various embodiments, both edge-side coupling surfaces or edge pixels or lateral pixels of the at least one line are widened. The light image can therefore have a comparatively large width on both edge sides with a simple device, wherein a high resolution is provided in the center. It is conceivable that the edge-side coupling surfaces, viewed in the direction of the at least one line, have different widths in relation to one another. If the optical unit is used, for example, in the vehicle headlight, the edge-side coupling surface which is spaced apart farther from the longitudinal axis of the vehicle may thus be wider than the inner edge-side coupling surface.

The vehicle, in which the optical unit (primary optical unit) is usable with a headlight, can be an aircraft or a water-based vehicle or a land-based vehicle. The land-based vehicle can be a motor vehicle or a rail vehicle or a bicycle. The use of the vehicle headlight in a truck or passenger automobile or motorcycle may be provided.

In various embodiments, the coupling surfaces are formed convexly when viewed in a plane which extends in the direction of the at least one line and in the direction of the optical main axis of the optical unit. In various embodiments, the coupling surfaces have a curved shape in this plane.

Furthermore, the coupling surfaces can be embodied as oblong or weblike in a direction transverse to the at least one line and transverse to the optical main axis. In this case, they can each form a part of a cylindrical lateral surface.

The coupling surfaces may press against one another, whereby a transition of the coupling surfaces is not visible or is hardly visible in the light image.

The middle coupling surfaces may be embodied identically, which results in a uniform light image in the middle or central region. The middle or central coupling surfaces may be all coupling surfaces without the edge-side coupling surfaces. Vertexes of the middle coupling surfaces are preferably in a common plane which extends, for example, transversely to the optical main axis and in the direction of the at least one line.

A high light image quality with a high level of cost-effectiveness at the same time can be provided if the optical unit (primary optical unit) has 6 to 14, e.g. 6 to 12 coupling surfaces, which may accordingly be provided for 6 to 14, e.g. 6 to 12 radiation sources. In use of the optical unit (primary optical unit), such a number of coupling surfaces results in a low power consumption if a corresponding number of radiation sources is used, and a light image having a high resolution.

In various embodiments, at least one lateral coupling surface extends, proceeding from the adjacent coupling surface, to its vertex with a first, e.g. curved surface section. It can be inclined in relation to the optical main axis. A second, e.g. curved surface section can then extend away from the vertex, which may be inclined in relation to the optical main axis. The second surface section can be wider, viewed in the direction of the line, than the first surface section. Furthermore, a depth of the second surface section measured in the direction of the optical main axis may be greater than a depth of the middle coupling surfaces. A widened coupling surface can therefore be implemented with a simple device.

The decoupling surface of the optical unit (primary optical unit) may be embodied asymmetrically, whereby an asymmetrical light image can be formed, which may be provided for a vehicle headlight. The decoupling surface is e.g. embodied as oblong and preferably extends transversely to the optical main axis and in the direction of the at least one line. The decoupling surface can have four corner regions on the circumference. To form the asymmetry, with a simple device, at least one corner region is or a plurality of corner regions or all corner regions are embodied as curved or trimmed or rounded. This embodiment of the corner region or the corner regions furthermore has the result that undesired light reflections are suppressed and artifact formation in the light distribution is reduced or avoided. The corner regions on the one side of the decoupling surface, viewed in the direction of the at least one line, can have a smaller radius in this case than the corner regions of the other side. If the optical unit is installed in the vehicle headlight, for example, the corner regions having the large radius may thus be arranged on the bottom and the corner regions having the small radius are arranged on top. The small radius is imaged on the road by the mirroring of the secondary lens.

In various embodiments, the optical unit (primary optical unit) has a radial collar between the coupling surfaces and the decoupling surface for simple installation when viewed in the direction of the optical main axis. It is therefore enclosed by a radial collar, via which it can be fastened.

For simple formation of an asymmetry of the optical unit (primary optical unit), the optical main axis can extend between two middle coupling surfaces when viewed in the direction of the line. In various embodiments, the optical main axis is arranged offset in relation to the middle of the line. For example, if 7 coupling surfaces having 5 middle coupling surfaces are provided, the optical main axis can thus be arranged, for example, between the central coupling surface and the coupling surface adjacent thereto.

In various embodiments, a respective middle coupling surface is embodied such that it is usable for illuminating an angle range of a light image of less than or equal to 3°. The angle range is preferably measured for this purpose in a plane which lies in the optical main axis and which extends in parallel to the extension direction of the line. In the installed state of the optical unit (primary optical unit) in the headlight, this can be the horizontal plane. The angle ranges of the coupling surface essentially adjoin one another, whereby a homogeneous light image is enabled.

The optical unit (primary optical unit) may furthermore be embodied such that an illuminated angle range in a plane in which the optical main axis lies and which extends parallel to the extension direction of the line or horizontally is between +/−20°, e.g. between +/−40°, e.g. between −20° and +12°.

Furthermore, the optical unit (primary optical unit) can be embodied such that it is provided for illuminating an angle range of the light image, in a plane which extends parallel to the optical main axis and transversely to the extension direction of the line or vertically, of 7°. If the optical main axis marks a 0° position, the illuminated angle range can thus extend in this plane, for example, from −2° to +5°.

According to various embodiments, an optical unit, e.g. a secondary optical unit, which is embodied as a lens, for example, is provided for a vehicle headlight. It can have a coupling surface and a decoupling surface. A structure may be provided in this case in the coupling surface and/or in the decoupling surface, using which transitions of at least two or a part of or all of the radiation sources are smoothed out or blurred or "smoothed". A uniform light image can be provided in a simple manner in this way.

The structure of the optical unit (secondary optical unit) is formed, for example, by lines. They can extend with parallel spacing in relation to one another. Furthermore, the lines may extend transversely to the optical main axis and/or transversely to the line of the radiation source matrix. In the installed state of the optical unit (secondary optical unit), for example, in the vehicle headlight, the lines can extend in the vertical direction.

The smoothing in a respective line of the optical unit (secondary optical unit) takes place in an angle range in the light image of 0.2° to 3°, e.g. 0.2° to 0.8°, wherein the angle range is viewed in a plane in which the optical main axis extends and which extends in the direction of the line of the radiation source matrix or in the horizontal direction in the installed state.

The optical unit (secondary optical unit) preferably has an asymmetrical coupling surface and/or an asymmetrical decoupling surface.

The decoupling surface of the optical unit (secondary optical unit) and/or the coupling surface of the optical unit (secondary optical unit) can have a vertex, wherein a first surface section and a second surface section can extend away from the vertex. The first surface section is preferably longer than the second surface section. An asymmetrical decoupling surface can thus be provided in a simple manner. The optical main axis may extend through the vertex or vertexes. Furthermore, the decoupling surface and/or the coupling surface can be embodied as convex or curved when viewed in a plane which extends along the optical main axis and can extend along the line of the radiation source matrix or in the horizontal direction in the installed state.

Furthermore, it is conceivable that the optical unit (primary optical unit, secondary optical unit) consists of silicone, which results in less weight. Furthermore, the optical unit (primary optical unit, secondary optical unit) is, for example, a lens. It is conceivable to provide the optical unit (primary optical unit, secondary optical unit) for a high-beam function upon use in the vehicle headlight.

According to various embodiments, a module is provided having a radiation source matrix and having an optical unit (primary optical unit) according to one or more of the preceding aspects. This achievement of the object has the effect that if needed, with little device expenditure, multiple modules can be easily combined and the light images can be superimposed. For example, if a module having 6 to 12 radiation sources arranged in a matrix is provided, a combination of two modules can thus result in 12 to 24 pixels or, upon the superposition of three modules, 18 to 36 pixels.

The radiation source matrix is formed, for example, from light-emitting diodes (LEDs). One LED or light-emitting diode can be provided in the form of at least one individually housed LED or in the form of at least one LED chip, which has one or more light-emitting diodes. Multiple LED chips can be mounted on a common substrate ("submount") and can form one LED or can be fastened individually or jointly, for example, on a circuit board (for example, FR4, metal core circuit board, etc.) ("CoB"=Chip on Board). The at least one LED can be equipped with at least one separate and/or common optical unit for beam guiding, for example, with at least one Fresnel lens or a collimator. Alternatively or additionally to inorganic LEDs, for example, based on AlInGaN or InGaN or AlInGaP, in general organic LEDs (OLEDs, for example, polymer OLEDs) are also usable. The LED chips can be directly emitting or can have an upstream phosphor. Alternatively, the LED can be a laser diode or a laser diode arrangement. Providing an OLED luminescent layer or multiple OLED luminescent layers or an OLED luminescent region is also conceivable. The emission wavelengths of the LED can be in the ultraviolet, visible, or infrared spectral range. The LEDs can additionally be equipped with a separate converter. The LED chips may emit white light in the standard ECE white area of the automotive industry, for example, implemented by a blue emitter and a yellow/green converter.

The module may have a circuit board or printed circuit board or metal core printed circuit board (MCPCB) or an AL MCPCB, on which the radiation sources are fastened in one or more lines. Furthermore, the optical unit (primary optical unit) can be fixed on the circuit board, e.g. via an optical unit holder. A compact module can thus be embodied with an extremely simple device. The optical unit holder is formed simply by webs, for example. The webs can in turn form a frame, which encloses the radiation sources. The optical unit (primary optical unit) can then be fastened via its radial collar in the optical unit holder.

Furthermore, a terminal can be provided on the circuit board for the electrical contact and/or control of the radiation source matrix. This terminal is, for example, a plug or a socket. Furthermore, a so-called "binning resistor" or container resistor can be provided on the circuit board. In addition, it is conceivable to arrange an NTC (negative temperature coefficient) resistor on the circuit board to avoid overheating of the module. Furthermore, control electronics can be attached to the circuit board.

According to various embodiments, an arrangement having at least two groups or assemblies is provided. A respective group has in this case a radiation source matrix, from each of which an optical unit (primary optical unit) according to one or more of the preceding aspects is connected downstream. Furthermore, a respective group has an optical unit (secondary optical unit), which is designed e.g. according to one or more of the preceding aspects, and which is connected downstream of the primary optical unit. The light images of the groups may be superimposed.

Various embodiments may have the effect that using the arrangement, with a simple device, a resolution of the emitted light image of the groups can be increased. In a respective group, the respective radiation source matrix with the associated optical units (primary optical units) can be designed in each case as a module according to one or more of the preceding aspects. By increasing or decreasing the number of the groups, the resolution of the emitted light image of the groups can therefore be set with a simple device.

In various embodiments, it can be provided in the arrangement that the optical main axis of a respective group is offset in parallel to the optical main axis of the respective other group. The optical main axes can lie in this case in a plane which extends parallel to the extension direction of the line of the radiation source matrices or which extends horizontally, e.g. in the installed state of a vehicle headlight.

The groups may be embodied identically.

A spacing of the optical main axes of the groups may be selected such that the illuminated angle ranges of the middle coupling surfaces overlap uniformly. This can result in a resolution which is given by the following formula: "angle range of a middle coupling surface/number of the groups". If the illuminated angle range (pitch) of a middle coupling surface is 3°, for example, with uniform superposition of two groups, a resolution of 1.5° can thus be achieved in the region of the middle coupling surfaces. Two groups can thus be superimposed with half pitch.

According to various embodiments, a headlight, e.g. for a vehicle, having a module or an arrangement according to one or more of the preceding aspects is provided.

Furthermore, a headlight system for a vehicle can be provided according to various embodiments, which has a left and a right headlight according to the preceding aspect. The illuminated angle ranges of the middle coupling surfaces of the module or of the arrangement of the left headlight can then be overlapped with the illuminated angle ranges of the middle coupling surfaces of the module or of the arrangement of the right headlight. The overlap occurs, for example, congruently or the overlap can be produced by an offset. With two headlights, it is now possible to superimpose the central region congruently, wherein an asymmetrical light distribution adjoins the superimposed light image on the left and right. If an offset is provided, the superimposed region of both headlights can be offset by a specific fraction of the pitch, for example, such as one-fourth pitch, for example. The resolution can be increased further in this way.

| List of Reference Numerals: | |
|---|---|
| optical unit (primary optical unit) | 1 |
| decoupling surface | 2 |
| coupling surface | 4 |
| radiation source matrix | 6 |
| corner region | 8 to 14 |
| LED | 16 to 28 |
| coupling surface | 30 to 42 |
| optical unit (secondary optical unit) | 44 |
| coupling surface | 46 |
| decoupling surface | 48 |
| line | 50 |
| vertex | 52 |
| vertex | 54 |
| optical main axis | 56 |
| arrangement | 58 |
| first group | 60 |
| second group | 62 |
| module | 64 |
| light image | 66 |
| printed circuit board | 68 |
| frame | 70 |
| radial collar | 72 |
| terminal | 74 |
| binning resistor | 76 |
| NTC resistor | 78 |
| control module | 80 |
| line | 82 to 88 |
| light image | 90 to 100 |

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A headlight, comprising:

a module, comprising:

a radiation source matrix; and an optical unit, comprising:

a plurality of light-transmissive optical coupling surfaces (30-42) positioned in light-receiving relation to the radiation source matrix (6), which are arranged in at least one line, the plurality comprising at least three optical coupling surfaces (30-42) of which at least one intermediate optical coupling surface (32-40) is positioned at an intermediate location between line ends of the at least one line; and at least one optical decoupling surface;

wherein each of two terminal said optical coupling surfaces (30, 42), which is arranged at a respective line end of the line formed by the plurality of coupling surfaces arranged in at least one line, is wider, when viewed in a direction of the at least one line, than the at least one intermediate optical coupling surface (32-40).

2. The headlight as claimed in claim 1, wherein the at least one decoupling surface (48) is configured oblong along the at least one line and asymmetrically transverse to the at least one line.

3. A headlight, comprising:

an arrangement, comprising:

at least two groups, which each have a radiation source matrix, from each of which a primary optical unit is connected downstream, the primary optical unit comprising:

a plurality of light-transmissive optical coupling surfaces (30-42) positioned in light-receiving relation to the radiation source matrix (6), which are arranged in at least one line, the plurality comprising at least three optical coupling surfaces (30-42) of which at least one intermediate optical coupling surface (32-40) is positioned at an intermediate location between line ends of the at least one line; and at least one optical decoupling surface;

wherein each of two terminal said optical coupling surfaces (30, 42), which is arranged at a respective line end of the line formed by the plurality of coupling surfaces arranged in at least one line, is wider, when viewed in a direction of the at least one line, than the at least one intermediate optical coupling surface (32-40);

and from each of which a secondary optical unit is connected downstream, the secondary optical unit comprising:

a light-transmissive optical coupling surface and an optical decoupling surface, wherein at least one of the optical coupling surface or the decoupling surface has a structure, using which transitions between radiation sources are smoothed;

wherein light images of the groups are superimposed.

4. The headlight as claimed in claim 3, wherein the at least one decoupling surface (48) is configured oblong along the at least one line and asymmetrically transverse to the at least one line.

5. A headlight system for a vehicle, the headlight system comprising:

a left headlight and a right headlight, each headlight comprising:

a module, comprising:

a radiation source matrix; and an optical unit, comprising:

a plurality of light-transmissive optical coupling surfaces (30-42) positioned in light-receiving relation to the radiation source matrix (6), which are arranged in at least one line, the plurality comprising at least three optical coupling surfaces (30-42) of which at least one intermediate optical coupling surface (32-

40) is positioned at an intermediate location between line ends of the at least one line; and at least one optical decoupling surface;

wherein each of two terminal said optical coupling surfaces (30, 42), which is arranged at a respective line end of the line formed by the plurality of coupling surfaces arranged in at least one line, is wider, when viewed in a direction of the at least one line, than the at least one intermediate optical coupling surface (32-40);

wherein an illuminated angle ranges of the middle optical coupling surfaces of the module of the left headlight overlap with the illuminated angle ranges of the middle optical coupling surfaces of the module of the right headlight.

6. The headlight system as claimed in claim 5, wherein the overlap occurs congruently or wherein the overlap occurs with an offset.

7. The headlight system as claimed in claim 5, wherein the overlap occurs congruently or wherein the overlap occurs with an offset in the horizontal direction.

8. The headlight system as claimed in claim 5, wherein the at least one decoupling surface (48) is configured oblong along the at least one line and asymmetrically transverse to the at least one line.

9. A headlight system for a vehicle, the headlight system comprising:

a left headlight and a right headlight, each headlight comprising:

an arrangement, comprising:

at least two groups, which each have a radiation source matrix, from each of which a primary optical unit is connected downstream, the primary optical unit comprising:

a plurality of light-transmissive optical coupling surfaces, (30-42) positioned in light-receiving relation to the radiation source matrix (6), which are arranged in at least one line, the plurality comprising at least three optical coupling surfaces (30-42) of which at least one intermediate optical coupling surface (32-40) is positioned at an intermediate location between line ends of the at least one line; and at least one optical decoupling surface;

wherein each of two terminal said optical coupling surfaces (30, 42), which is arranged at a respective line end of the line formed by the plurality of coupling surfaces arranged in at least one line, is wider, when viewed in a direction of the at least one line, than the at least one intermediate optical coupling surface (32-40);

and from each of which a secondary optical unit is connected downstream, the secondary optical unit comprising:

a light-transmissive optical coupling surface and an optical decoupling surface, wherein at least one of the optical coupling surface or the decoupling surface has a structure, using which transitions between radiation sources are smoothed;

wherein light images of the groups are superimposed;

wherein an illuminated angle ranges of the middle optical coupling surfaces of the arrangement of the left headlight overlap with the illuminated angle ranges of the middle optical coupling surfaces of the arrangement of the right headlight.

10. The headlight system as claimed in claim 9, wherein the overlap occurs congruently or wherein the overlap occurs with an offset.

11. The headlight system as claimed in claim 9, wherein the at least one decoupling surface (48) of each primary optical unit is configured oblong along the at least one line and asymmetrically transverse to the at least one line.

* * * * *